US006426485B1

(12) United States Patent
Bulgajewski et al.

(10) Patent No.: US 6,426,485 B1
(45) Date of Patent: Jul. 30, 2002

(54) LIGHT DIFFUSING SIGNAL MIRROR HEATER

(75) Inventors: Edward F. Bulgajewski, Genoa; Timothy A. Norris, Crystal Lake, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/919,440

(22) Filed: Jul. 31, 2001

(51) Int. Cl.[7] ..... H05B 1/00
(52) U.S. Cl. ..... 219/219; 219/548
(58) Field of Search ..... 219/219, 203, 219/522, 548

(56) References Cited

U.S. PATENT DOCUMENTS 4,857,711 A 8/1989 Watts
4,931,627 A 6/1990 Watts
5,716,536 A * 2/1998 Yokoto et al. ..... 219/219
6,149,287 A * 11/2000 Pastrick et al. ..... 340/475
6,299,333 B1 * 10/2001 Pastrick et al. ..... 340/475
6,307,188 B1 * 10/2001 Bulgajewski ..... 219/505
6,356,376 B1 * 3/2002 Tonar et al. ..... 359/265

* cited by examiner

*Primary Examiner*—Teresa Walberg
*Assistant Examiner*—Vinod D Patel

(57) ABSTRACT

A heater for a lighted signal mirror assembly is disclosed. The heater delivers a diffused lighted signal to the mirror assembly. The heater also provides heating capabilities to substantially an entire reflective surface of the mirror assembly, including that portion on the reflective surface of the mirror assembly surrounding that area through which the diffused lighted signal is emitted.

20 Claims, 2 Drawing Sheets

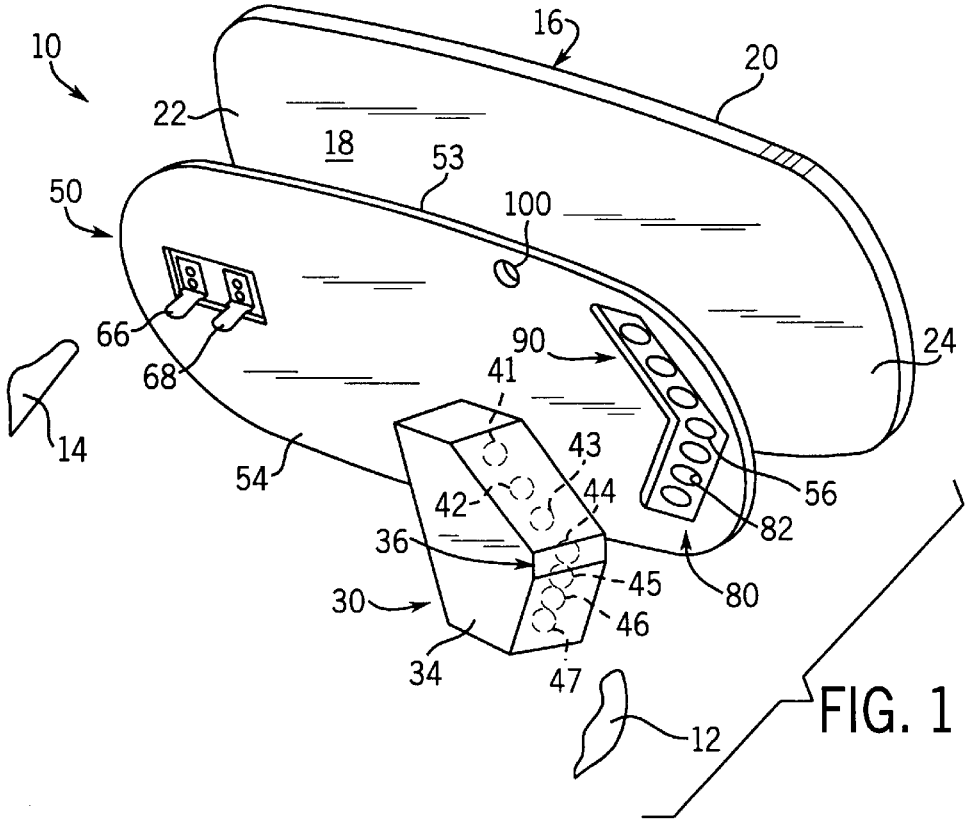
FIG. 1
FIG. 2
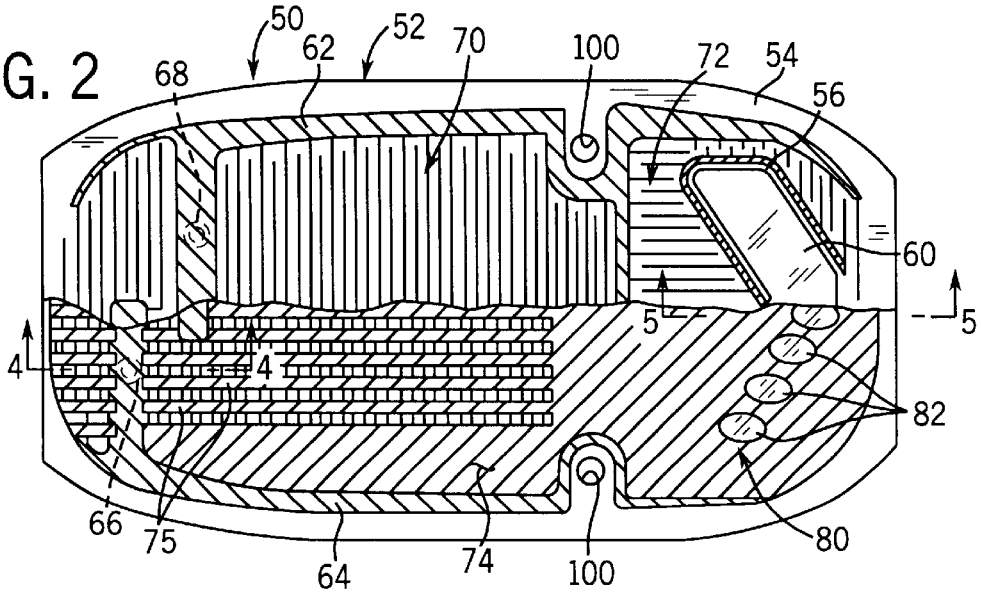

LIGHT DIFFUSING SIGNAL MIRROR HEATER

FIELD OF THE INVENTION

The present invention generally relates to a heater and, more particularly, to a heater for a lighted signal mirror, preferably, for vehicles and the like, and wherein the heater diffuses the light used to illuminate the signal mirror.

BACKGROUND OF THE INVENTION

The provision of side view mirrors, especially on automobiles and the like, is well known in the prior art. More specifically, side view mirrors heretofore devised and utilized are known to include familiar, expected, and obvious structural configurations or housings which mount to an exterior of the vehicle and have a reflective element or glass mirror.

Of course, it is not necessary to heat a mirror located in the open air, or the exterior mirror of a vehicle, unless the temperature of the mirror surface falls below the dew-point of the surrounding air, or if the mirror can no longer fulfill its function properly because the reflective surface thereon becomes fogged or is covered with ice or snow. Moreover, such mirrors located in the open air often become unusable because of increased humidity which precipitates as condensation on the mirror surface.

Devices for heating a reflective element or mirror are known. With most such mirrors, an electrical heating element is arranged adjacent to an inner surface of the mirror. Positive temperature coefficient (PTC) heaters, such as those disclosed in U.S. Pat. Nos. 4,857,711 and 4,931,627 To Leslie M. Watts, include a substrate having an electrical pattern thereon and an electrically resistive layer of material formed thereover such that the heater offers a resistance which increases in response to increasing temperatures.

As will be appreciated, many automobile accidents are caused by lane-changing, freeway merging or front-to-rear crashes. In an effort to curtail such accidents, turn indicators or signaling devices have recently been incorporated for use with side view mirrors of vehicles. When a turn signal is activated inside the vehicle, a flashing design or pattern appears within a predetermined area on the corresponding side mirror to alert drivers in the blind spot of the turning vehicle. Otherwise, the side view mirrors generally appear as regular rearview mirrors when the turn signal is not actuated or enabled. With the increased popularity of trucks, SUVs and vans coupled with the use of such vehicles for towing, the signal from the side view mirror may be the only indication drivers—a few car lengths back—may have regarding intentions of the vehicle ahead. As will be appreciated, the taillights are often hidden by these trailer vehicles or by what is being towed.

In one form, such turn indicators include a mounting arranged to the rear side of the reflective element and within a blind cavity defined by a rear view mirror housing. An electrified light source, frequently including an LED array is provided within the mounting. As will be appreciated, the light source is operably connected to a turn signal indicator in the vehicle such that the light source emits a light directed toward a predetermined area on the rear surface of the mirror or reflective element in response to activation of the turn signal indicator. However, it has been observed that the light directed from the light source may have an objectionable intensity. Because of the visibility of the LEDs through the glass mirror, the mirror assembly may take on an unsightly appearance.

As can be appreciated, when adding a signal indicator to a mirror assembly, it is important to properly locate the signal indicator with respect to other components of the mirror assembly. Of course, precision and accuracy generally add to the overall cost of the mirror assembly.

Thus, there is a need and continuing desire for an economical heater capable of providing heat across substantially the entire face of the mirror including that section wherein a signal indication is provided and wherein the light emitted from the mirror for signaling is diffused to soften the light intensity and minimize an unsightly appearance of the light source used to direct light toward the rear surface of the mirror.

SUMMARY OF THE INVENTION

The present invention relates to a heater for a vehicle mirror assembly including a reflective element having inner and outer surfaces and a signal indicator with a light source positioned to face and direct light toward the inner surface of the reflective element. The signal indicator may be a turn signal, a braking light, or any other suitable form of signal indicator.

According to the present invention, the heater includes a heating element adapted to extend between the inner surface of the reflective element and the signal indicator. The heating element includes a substrate having an unobstructed area thereon arranged in predetermined relation relative to and through which light from the signal indicator light source is emitted.

The heating element defines a patterned opening arranged in registry with the unobstructed predetermined area on the substrate through which light from the signal indicator light source emitted. As such, and when the signal indicator is enabled, light is emitted through the heating element and directed toward the mirror to, ultimately, provide a lighted signal pattern discernable to drivers of overtaking vehicles.

The heating element for the heater preferably includes an electrical pattern on the substrate. A conductive layer of resistive material is also deposited on the substrate in operable combination with the electrical pattern. In a preferred embodiment, the conductive layer comprises a positive temperature coefficient resistive material which is substantially impermeable to light. In a preferred embodiment, the resistive material or thermistor layer defines the patterned opening for the heating element and through which the signal light pattern is emitted. Alternatively, the heating element could be a fixed resistance heater.

According to one aspect of the present invention, a light diffusing treatment is directly applied to at least the unobstructed predetermined area of the substrate exposed to the signal indicator light and in registry with the patterned opening in the conductive layer of material. In one form, the light diffusing treatment is directly applied to at least the unobstructed predetermined area of the substrate as a transparent diffuser coating. Alternatively, however, other forms of light diffusing treatments, including etching, painting, roll coating, or the like, can be directly applied to the predetermined area of the substrate to effect the transmissivity of the light passing therethrough. Regardless of the type of treatment used, when the signal indicator light source is enabled, diffused light passes from the heating element and, ultimately, through the mirror to provide the signal light pattern to other drivers. The application of a light diffusing treatment directly to the substrate allows inexpensive and simple production of diffused light to be emitted from the mirror assembly.

In a preferred embodiment, the substrate, the light diffusing treatment, the electrical pattern on the substrate, and the conductive layer are all substantially coextensive relative to each other. Moreover, in one form, the diffusing treatment preferably has a color added thereto such that a colored signal light pattern using diffused light will be visually emitted from the mirror assembly when the signal indicator light source is enabled. In another form, the diffusing treatment is applied directly to the substrate in a manner whereby allowing different lighting sources to be used in combination with the signal indicator without adversely affecting signal quality.

Another aspect of the present invention relates to providing a heater with the capability to heat the entire surface of the mirror or reflective element including the section of the mirror through which the lighted signal is emitted. In this embodiment, the electrical pattern provided on said substrate includes a first zone, extending across a majority of the inner surface of the mirror, and a second zone, arranged in substantially surrounding relation relative to the area on the substrate through which the signal light is emitted. The electrically resistive layer of material deposited on the substrate is arranged in operable combination relative to both the first and second zones of said electrical pattern whereby providing heating capability across substantially the entire of the mirror including that area on the mirror through which the signal for other drivers is provided.

In one form, the substrate for the heating element is provided with one or more locating or positioning apertures which facilitate placement or location of the heater element during assembly of the mirror. As will be appreciated, if the substrate of the heating element were to be misplaced relative to the signal indicator during assembly of the mirror, the area on the substrate through which the light of the lamp assembly is directed, along with the conductive coating arranged in substantially surrounding relation relative to the predetermined area on the substrate, can likewise be misplaced, thus, adversely affecting the signal light emitted from the signal indicator lamp assembly. To reduce such concerns, and according to a preferred embodiment, aperture positioning locators are provided on the substrate in edge registration with at least the electrical pattern on the substrate thereby providing an indicator for locating or positioning such apertures which aid in proper registration or assembly of and between the components of the mirror assembly. Notably, however, the apertures do not adversely affect the heating capabilities of the heating element because the heater is adapted to heat substantially the entire surface of the mirror, including the section of the mirror substantially adjacent the apertures.

The heating element furthermore preferably includes an adhesive layer deposited to the surface of the substrate arranged adjacent to the inner surface of the mirror. As such, the heating element adhesively bonds to the mirror. Preferably, a removable protective layer is disposed over the adhesive layer to facilitate transportation and shipping of the heating element. Another adhesive layer is preferably deposited to the surface of the electrical heating element disposed furthest from the inner surface of the mirror. With such design, a removable protective layer is disposed over the adhesive layer to facilitate transportation and shipping of the heating element. It should also be noted, in an alternative form of the invention, one of the adhesive layers can be provided with a patterned opening arranged in registry with the unobstructed area on the substrate of the heating element. In this embodiment, the light diffusing treatment would not necessarily have to be applied to the substrate, thereby possibly reducing manufacturing and/or assembly costs for the mirror.

A feature of the present invention involves providing a light diffusing signal mirror heating element.

Another feature of the present invention involves reducing the complexity and cost of producing a heated mirror assembly embodying a signal which is illuminated with diffused light.

Still another feature of the present invention involves providing a signal mirror heating element having the capability to heat substantially the entire surface of the mirror including that area of the mirror through which the signal light is emitted.

Yet another feature of the present invention involves providing a heater for a mirror assembly embodying a signal which is illuminated with diffused light and wherein the diffuser for the light is arranged substantially adjacent to an inner surface of the mirror, thus, eliminating a potential area for unclear and/or reduced light transmission.

Another feature of the present invention is to provide a heater for a mirror assembly embodying a signal which is illuminated with diffused light and wherein the heating element can be designed to modify the translucency of light emitted from the mirror.

Still another feature of the present invention is to provide a heater for a mirror assembly embodying a signal which is illuminated with diffused light and wherein the light diffusing treatment can be colored such that the signal lighting emitted from the mirror appears both diffused and colored thus, softening and equalizing the intensity of the light while concurrently aiding in the transmission of the signal light.

These and other features, aims, and advantages of the present invention will become more readily apparent from the following drawings, the detailed description, and the appended claims.

DETAILED DESCRIPTION OF THE DRAWINGS

FIG. 1 is a perspective view illustrating, in disassembled relation, various components of a heated mirror assembly having a signal indicator;

FIG. 2 is an enlarged plan view of a heating element for an exterior mirror, with certain components of the heating element being partially removed for illustrative convenience;

DESCRIPTION OF THE INVENTION

Figure 3:
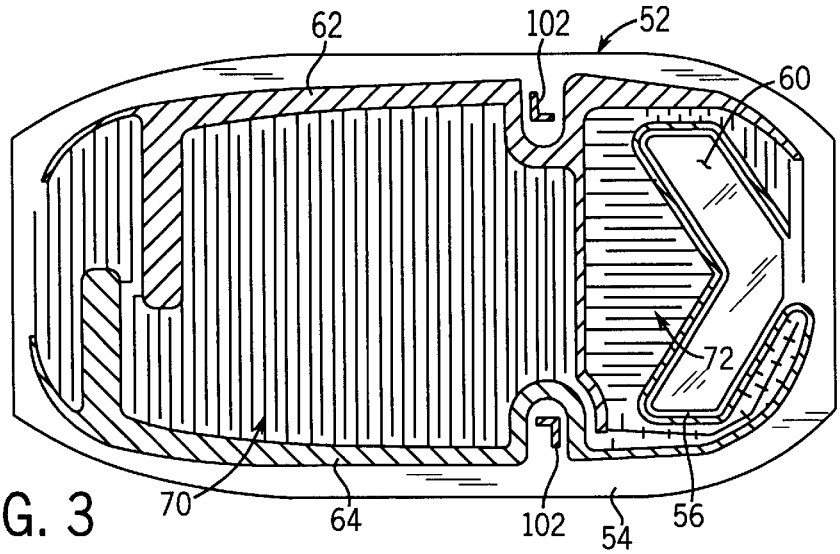
FIG. 3 is an enlarged plan view of a substrate forming part of the present invention and having one form of an electrical pattern thereon.

While the present invention is susceptible of embodiment in various forms, there is shown in the drawings and will hereinafter be described in detail a preferred embodiment of the invention with the understanding the present disclosure is intended to set forth an exemplification of the invention which is not intended to limit the invention to the specific embodiment illustrated.

Referring now to the drawings, wherein like reference numerals indicate like parts throughout the several views, there is shown in FIG. 1 an exterior mirror assembly which operates as a combination rearview mirror and signaling apparatus and which embodies principals and concepts of the present invention. The mirror assembly is generally designated by reference numeral 10. As illustrated, mirror assembly 10 includes a housing 12 securable to a side of a vehicle 14 such as, for example, an automobile, truck, SUV, van, recreational vehicle, motorcycle, or watercraft. While only a single mirror assembly 10 is illustrated for exemplary purposes it will be appreciated the vehicle 14 is likely to have a second mirror assembly (not shown) secured to an opposite side of the vehicle. Since the mirror assemblies arranged on opposed sides of the vehicle are substantially similar, however, only mirror assembly 10 need be discussed in detail to provide a complete understanding of the salient features thereof. It should be noted, the mirror assembly 10 may take the form of any number of known mirror designs, such as, but not limited to, an electrochromic mirror assembly, as long as the mirror assembly incorporates one or more features of the present invention.

Each mirror assembly 10 further includes a reflective element 16 having inner and outer generally parallel surfaces 18 and 20, respectively. In the illustrated embodiment, the reflective element 16 includes a glass mirror with a reflective element on the inner or outer side or surface thereof and having a first end 22, arranged closer to a driver (not shown) of the vehicle when the mirror assembly 10 is mounted thereon than is a second end 24 of the mirror 16.

In the illustrated embodiment, each mirror assembly 10 furthermore includes a signal indicator 30 arranged within the mirror housing 12 toward the inner and closer to the second end 24 of the mirror 16. The signal indicator 30 comprises a lamp assembly mounting 34 having a suitable light source, generally indicated by reference numeral 36, for emitting light rearwardly toward and, ultimately, through the reflective element or mirror 16.

As will be readily appreciated, the light source 36 for producing the light, ultimately passing through the mirror or reflective element 16, to provide an illuminated signal can take any of a myriad of different forms or types without detracting or departing from the spirit and scope of the present invention. Preferably, the light source 36 includes an LED array comprised of a plurality of LEDs. 41, 42, 43, 44, 45, 46 and 47 which illuminate or operate in response to actuation of a conventional manually actuated turn signal apparatus (not shown) within the vehicle. Of course, a lesser or greater number of LEDs than that disclosed and illustrated would equally suffice. Alternatively, a conventional incandescent or halogen lamp could be used as the light source 36. Furthermore, a fluorescent lamp or light emitting diode may be used as the light source 36. The above examples are a few of those choices available for use as light source 36.

According to the present invention, a heating element, generally identified by reference numeral 50, extends between the mirror or reflective element 16 and the signal indicator 30. The purpose of heating element 50 is two fold. First, heating element 50 provides heating capability across a majority of the reflective surface of the mirror 16 including that portion through which an illuminated turning signal is emitted. Second, heating element 50 has a light diffusing treatment applied thereto for diffusing the lighting for the signal mirror thereby softening the intensity and minimizing the unsightly view of the light source in the background.

FIG. 2 illustrates a preferred construction for the heating element 50 which, in the preferred embodiment, is adapted to be bonded to the inner surface 18 of the mirror 16. As shown, heating element 50 comprises an electronically insulating substrate 52 preferably formed from a polyester film sheet which provides a support for subsequent layers of the heating element 50. Alternatively, the substrate 52 can be formed from polycarbonates or any other suitable material. In the exemplary embodiment, substrate 52 is approximately 0.0007 inches thick and includes a first side or surface 53 (FIG. 4) adapted to face the inner or rear surface 18 of mirror 16 and a second side or surface 54 (FIG. 4) adapted to face the light source 36 of lamp assembly 34. Preferably, substrate 52 is of generally the same shape and size of the heating element 50 and is generally coextensive therewith. In the exemplary form, substrate 52 has a profile substantially similar to the mirror 16. Notably, and toward one end thereof, the substrate 52 defines an unobstructed area 56 arranged in predetermined relation relative to and through which light from source 36 is emitted rearwardly toward the inner surface 18 of mirror 16.

According to the present invention, at least area 56 on the substrate 52 has a light diffusing treatment applied directly thereto. The purpose of the light diffusing treatment applied to at least the predetermined area 56 of the substrate through which light from the signal indicator 30 passes is to provide an inexpensive and simple method of producing diffused light to be emitted as a patterned light signal from the mirror assembly 10 (FIG. 1). The light diffusing treatment applied to at least area 56 of the substrate 52 can take different forms. In one form, the light diffusing treatment involves etching the surface of the predetermined area 56 of the substrate 52 such that diffused light is emitted from the heater 50. In a preferred form, the light diffusing treatment involves depositing directly onto, and extending over and across at least the predetermined area 56 of the substrate, a transparent light diffusing coating, schematically and generally represented in FIGS. 2 and 3 by reference numeral 60.

In a preferred form, the diffuser coating 60 is applied by depositing diffuser ink blended with a flattening paste directly to one side of and over at least the predetermined area 56 on the substrate 52. The diffuser ink can be made from any number of different commercially available inks. Notably, however, a Naz Dar 9600 series ink with a twenty percent flattening paste added thereto is particularly suitable for use according to the present invention. In a preferred embodiment, the diffuser coating 60 is directly deposited in a predetermined pattern on and bonds directly to the predetermined area 56 of the substrate 52 such that the substrate 52 and diffuser coating 60 are substantially coextensive. Like the unobstructed area 56 of the substrate 52 through which light from said light source 34 is emitted, the predetermined pattern of the diffuser coating 60 applied to the predetermined area 56 of the substrate 52 has a predetermined width and a predetermined length.

The predetermined pattern of the diffuser coating 60 is preferably screen printed onto the substrate 52. Those skilled in the art, however, will appreciate alternative methods of applying the diffuser coating 60 to the substrate 52, i.e., painting, spraying, rolling or a dot matrix, are acceptable and would equally suffice without detracting or departing from the spirit and scope of the present invention. In one form, the diffuser coating 60 is directly applied to the substrate 52 with a thickness ranging between about 6 microns to about 12 microns.

With the present invention, the transmissivity or level of diffused light passing through the predetermined area 56 of the substrate 52 can be modified by varying the opaqueness of at least the predetermined area 56 of the substrate 52 as through modifying the light diffusing treatment directly applied to the substrate 52. If so desired, and as will be appreciated by those skilled in the art, the light diffusing treatment applied to the substrate 52 can also be modified to effect varying degrees of opaqueness across either the predetermined width or predetermined length, or both, of the predetermined area 56 so as to further vary the transmissivity of diffused light emitted through the heating element 50 and directed toward the rear or inner surface 18 of and, ultimately, through the reflective element or mirror 16. As will be appreciated, and if desired or required, a coloring agent can be mixed with the diffuser ink thereby adding a color to the diffuser coating 60, thus, effecting the color of the diffused signal light emitted through the mirror assembly 10. For example, a suitable coloring agent can be added to the diffuser ink such that a red or amber color pattern of diffused light will be visually emitted from the mirror assembly 10 when the light source 34 is enabled.

Also deposited on one side of the substrate 52 is an electrical pattern or design. The electrical pattern preferably comprises a layer of printable, electrically conductive material. In a preferred form, the electrically conductive material on the substrate 52 comprises an electrically conductive silver polymer known to those skilled in the art. The conductive electrical pattern is preferably deposited on the substrate in a thickness ranging between about 8 to 10 microns.

Turning to FIG. 3, the electrical pattern on the substrate 52 preferably includes a buss system of the type disclosed in U.S. Pat. Nos. 4,857,711 or 4,931,627 To Leslie M. Watts, the applicable portions of which are incorporated herein by reference, although other electrical patterns consistent with the principles of the present invention would equally suffice. Suffice it to say, the exemplary form of buss system has two buss bars 62 and 64 each electrically connected to and extending from one of two conventional terminals 66, 68 (FIG. 1) whereby allowing heating element 50 to be connected to an external electrical power supply. In this form, each buss bar 62, 64 extends along substantially opposite portions of a peripheral edge of the substrate 52 and terminates in a free end. In the illustrated form, each buss bar 62, 64 has a decreasing area from its respective terminal connection toward its free end. Preferably, a plurality of spaced and generally parallel interdigitated electrodes extend generally perpendicular or normal from each buss bar 62, 64. That is, in the illustrated form, adjacent electrodes connect to opposite buss bars and extend in opposite parallel directions and terminate in spaced relation from the other buss bar.

As illustrated in FIG. 3, the electrical pattern provided on the substrate 52 includes first and second zones 70 and 72, respectively. As illustrated, the first zone 70 extends across a majority of the inner surface 18 (FIG. 1) of the reflective element or mirror 16. To advantageously allow heating of the mirror or reflective element 16 in the area through which a turning signal is emitted, the second zone 72 of the electrical pattern is arranged in substantially surrounding relation relative to the predetermined area 56 on the substrate 52 through which the light of the light source 36 is directed or emitted.

Returning to FIG. 2, deposited on the substrate 52 over the electrical pattern is a layer of conductive material 74. In one form, material 74 comprises a positive temperature coefficient (PTC) electrically resistive material or a thermistor layer. The PTC material 74 is preferably a screen printable PTC electrically conductive ink having a composition adjusted to have a desired electrical characteristic for the particular application. Preferably, the PTC material 66 deposited on the substrate is substantially impermeable to light passing therethrough.

For example, for automotive outside rearview mirror applications, a preferred screen printable PTC material has been found to comprise an eythlene vinyl acetate copolymer resin, such as DuPont 265 which comprises about 28 percent vinyl acetate monomer and about 72 percent eythlene monomer modified to have a sheet resistivity of 15,000 ohms per square. To achieve this electrical characteristic, this eythlene vinyl acetate copolymer resin is first dissolved in an aromatic hydrocarbon solvent such as naphtha, xylene or toluene at about 80 degrees C. and let down to where 20 percent of the total weight of the solution is solids. Carbon black, such as CABOT VULCAN PF, is added and mixed to bring the total solid content to about 50 percent by weight. This material is then passed through a three roll dispensing mill having a 0.1 to 1 mil nip clearance to further disperse and crush the solids. The material is further let down with about a twenty percent solids resin and solvent solution until the desired sheet resistivity is achieved.

In one form, the PTC material 74 is screen printed over the electrical pattern and onto the substrate 52 in a thickness of about 2.5 to about 5 microns. As illustrated in FIG. 2, the PTC material 74 is preferably deposited over the first zone 70 of the electrical pattern in a stripped pattern, including parallel spaced stripes 75, extending generally perpendicular to the interdigitated electrodes of the electrical pattern. Except as noted below, the PTC material 74 is deposited onto the substrate 52 in a substantially continuous layer extending over the second zone 72 of the electrical pattern.

When a voltage is applied across the terminals 66, 68 and, thus, across the electrode array, depending upon the ambient temperature and electrical characteristics of the PTC material 74, current will flow through the PTC material 74 between the electrodes causing the individual heating areas of element 50 to heat. As is known, the current flow and heating effect of the PTC material 74 depends on its temperature which will change as the ambient temperature changes and, at a predetermined temperature of the PTC material 74, the resistivity of material 74 increases causing the material 74 to no longer conduct current, whereby areas of element 50 no longer generate heat. Accordingly, it can be seen that the heating element 50 is self-regulating in accordance with the surrounding ambient temperature. Notably, the heating effect at any location across the heater 50 is controlled as a function of the power density at that location. Accordingly, it is possible to vary the heating effect at any given area of the substrate 52 in accordance with the specific thermodynamics of the application. For example, with automotive outside rearview mirror applications, heat loss from the mirror is greatest at the perimeter and at locations disposed furthest from the vehicle. Accordingly, the width of the PTC stripes 75 can be sized as required for a particular application. Because of the heat loss toward the outer end of the mirror assembly 10 (FIG. 1), a substantially continuous layer of PTC material 74 is preferably applied over the second zone 72 of the electrical pattern and, in the exemplary embodiment, in surrounding relation relative to the predetermined area 56 on the substrate 52.

The heating element 50 furthermore defines a patterned opening 80 arranged in registry with the predetermined area 56 on the substrate 52 through which diffused light is emitted. Preferably, the opening 80 has a chevron-like pattern or design. In the illustrated embodiment, the patterned opening 80 for the heating element 50 is defined by the layer of PTC material 74 overlying the second zone 72 of the electrical pattern.

In one form, the patterned opening 80 is defined by a series of light permeable openings 82 arranged in a generally chevron-like pattern relative to each other. As will be appreciated, the openings 82 are arranged in overlying registry with the frosted or diffuser coating 60 extending across or over the predetermined area 56 on the substrate 52. Preferably, each opening 82 defines a closed margin extending thereabout. Moreover, and although the openings 82 are illustrated as having a generally elliptical-like configuration, it will be appreciated that openings having other designs, i.e., circular, square, rectangular, triangular, trapezoidal, etc. would equal apply without detracting or departing from the spirt and scope of the present invention.

Figure 4:
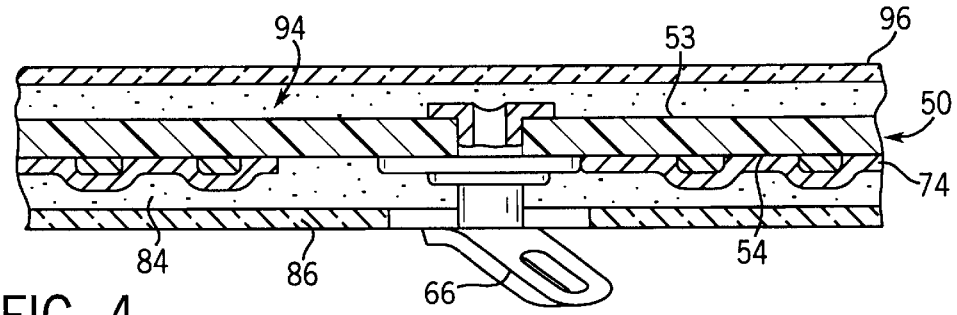
FIG. 4 is an enlarged sectional view taken along line 4—4 of FIG. 2.
Figure 5:
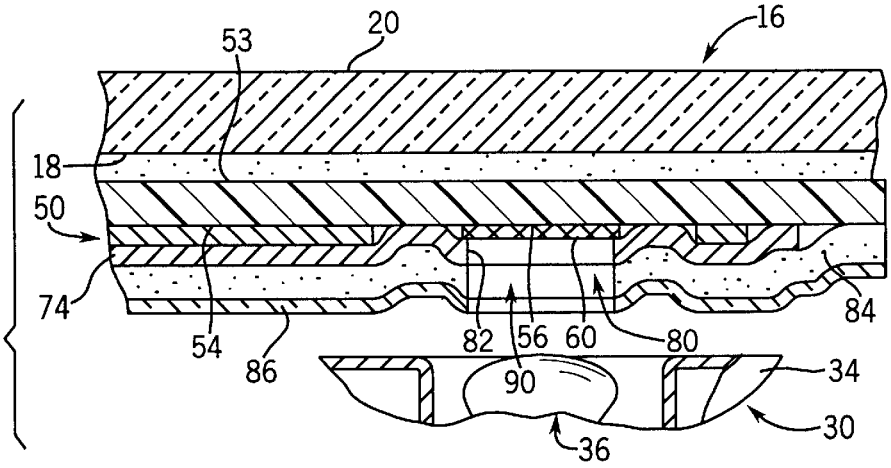
FIG. 5 is an enlarged sectional view taken along line 5—5 of FIG. 2.

Referring to FIG. 4, a layer of acrylic pressure sensitive adhesive 84 is deposited over the PTC material 74. Notably, the adhesive layer 84 is substantially impermeable to light passing therethrough. As schematically represented in FIG. 5, the portion of the adhesive layer 84, disposed toward the second or outer end of the heating element 50, defines a patterned opening 90 arranged in registry with the patterned opening 80 and in registry with the unobstructed predetermined area 56 on the substrate 52 through which diffused light is emitted. As will be appreciated, in the exemplary embodiment, opening 90 has a generally chevron-like pattern arranged in registry with the light permeable openings 82 defined by the PTC material 74. Of course, and without detracting or departing from the spirit and scope of the present invention, the patterned opening in the PTC material 74 can have a generally chevron-like shape while the patterned opening 90 of the adhesive layer 84 can comprise a series of openings arranged in registry with the patterned opening 80 on the PTC material 74 thereby providing substantially the same illuminated turning signal image to the rear or inner surface 18 of and, ultimately, through the reflective element or mirror 16. A removable protective coating 86, such as paper, is preferably disposed over the adhesive layer 84.

Returning to FIG. 4, and in exemplary embodiment, another adhesive layer of acrylic pressure sensitive adhesive 94 is deposited over the other surface of the substrate 52. A protective covering 96, such as paper, is removably arranged over the adhesive layer 94.

As schematically illustrated in FIG. 1, the heating element 50 includes one or more apertures, holes or openings 100 to aid in proper positioning or locating of the of the heating element 50 relative to other mirror assembly components. As will be appreciated, mislocating or poor positioning of the heating element 50 within the mirror housing 14 will likewise result in an adverse positioning effect on the area 56 defined by the substrate 52 relative to the light source 36. Of course, if the predetermined area 56 defined by the substrate 52 and through which diffused light is emitted, is erroneously offset or misaligned relative to the light source 36, such misalignment can adversely affect the quality of diffused light passing toward the reflective element 16 and, ultimately, can adversely affect the quality of the turn signal indicator emitted from the mirror. Thus, proper alignment of the predetermined area 56 on the substrate 52 relative to the light source is an important concern.

To address such concerns, the holes or apertures 100 defined by the substrate 52 of the heater 50 are edge positioned with the predetermined area 56 on the substrate to assure proper alignment therebetween. Returning to FIG. 3, and preferably concurrently with the electrical pattern being applied to and preferably edge registered relative to the substrate 52, one or more aperture locators 102 are deposited onto the substrate 52 thereby edge registering both the unobstructed predetermined area 56 through which diffused light is passed, along with the location whereat the holes, opening, or apertures 100 will be located. As such, a relationship is established and thereafter maintained between the predetermined area 56 on the substrate 52 and the holes or apertures 100. Thus, when the heater 50 is assembled to the mirror assembly 10, the located holes, openings or apertures 100 in the substrate 52 are used as assembly aids. That is, the located holes, openings or apertures 100 in the substrate 52 will facilitate and aid in proper positioning of the heating element 52 and the predetermined area 56 relative to the light source 36.

The heater 50 is arranged within the mirror housing 12 and the substrate 52 is preferably adhesively bonded to the inner surface 18 of the mirror. A power source is connected to the heater 50 across the terminals 66, 68. The first zone 70 of the electrical heating element 50 provides heating capabilities to the majority of the surface of the reflective element or mirror 16 while the second zone 72 of the electrical heating element 50 specifically provides heating capabilities across that area of the mirror 16 through which a diffused turning signal light is emitted. As will be appreciated, the capability to heat and, thus, maintain the turn signal area of a turning signal indicator mirror substantially free of ice, snow or other precipitation will provide heretofore unknown benefits and advantages to drivers and others whose view of normal turn signal indicators on a vehicle are obstructed or otherwise impaired.

Applying a light diffusing treatment to at least that predetermined area 56 on the substrate 52 such that diffused light is emitted by the heater 50 provides several advantages. For example, the light diffusing treatment reduces the luminescence of the light source 36 by refracting the light and, thus, softening the intensity of the light emitted rearwardly through the reflective element or mirror 16. In some conditions, using diffused light as a source enhances transmission of a patterned signal light. Additionally, the diffusing treatment applied to the substrate 52 minimizes the unsightly view of the LEDs or other suitable light source visible through element or mirror 16. Moreover, when coating 60 is used to diffuse the light, both a diffiused and colored light can advantageously be used to provide a patterned signal light on the mirror. As mentioned, the opaqueness of at least the predetermined area 56 through which the light from the signal indicator 30 is directed can be readily varied or modified across its predetermined pattern by the light diffusing treatment directly applied to the predetermined area 56 on the substrate 52 thereby yielding custom designed turning signal indicator mirrors which can use a myriad of different sources for the diffused lighting.

Applying the light diffusing treatment directly to at least the predetermined area 56 of the substrate 52, as compared to providing a separate light diffuser in combination with the signal turn indicator assembly 30, also provides significant structural benefits and advantages. That is, applying the light diffuser treatment directly to the substrate 52 such that diffused light is produced by shining a light through the heating element 50 reduces the component parts required to produce a turning signal indicator mirror using diffused lighting. Of course, reducing the number of component parts required for a turning signal indicator mirror having diffused lighting translates into cost reduction and, thus, savings for the manufacturer. Moreover, conditioning the substrate 52 with a light diffusing treatment eliminates concerns over delamination and a myriad of manufacturing drawbacks and related problems. Furthermore, treating the heater substrate 52 advantageously positions the light diffuser as close as possible to the mirror thereby inhibiting moisture or condensation buildup between the diffuser and the mirror, thus, eliminating a potential area for unclear and reduced light transmission.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A heater for a vehicle mirror assembly including a reflective element having inner and outer surfaces, and a signal indicator positioned to face and direct light toward the inner surface of said reflective element, said heater comprising:

a heating element extending between the inner surface of said reflective element and said signal indicator, said heating element including an unobstructed area adapted to allow light from said signal indicator to pass therethrough; and a light diffusing treatment positioned over the unobstructed area of the heating element to diffuse light passing through the heating element.

2. The heater according to claim 1, wherein the light diffusing treatment is directly applied to the heating element.

3. The heater according to claim 1, wherein said heating element includes a substrate which defines said unobstructed area, and wherein the light diffusing treatment is directly applied to the substrate.

4. The heater according to claim 3, wherein said heating element further includes an electrical pattern deposited on a surface of said substrate, and a conductive layer deposited in operable combination with the electrical pattern and covering most of the surface of the substrate on which the electrical pattern is deposited, the conductive layer comprising a positive temperature coefficient material which is substantially impermeable to light except for a patterned opening arranged in registry with the unobstructed area of the substrate to allow light to pass therethrough.

5. The heater according to claim 4, wherein said patterned opening of the conductive layer is defined by a series of light permeable openings arranged in a predetermined pattern relative to each other.

6. The heater according to claim 3, wherein an adhesive layer is deposited on a surface of the substrate, the adhesive layer being substantially impermeable to light except for a patterned opening arranged in registry with the unobstructed area of the substrate to allow light to pass therethrough.

7. The heater according to claim 1, wherein the light diffusing treatment is a light diffusing coating directly applied to the heating element.

8. The heater according to claim 7, wherein the light diffusing coating has a color added thereto such that a colored pattern of light will be visually emitted from the mirror assembly when said signal indicator is enabled.

9. The heater according to claim 8, wherein the light diffusing coating varies in translucency across a predetermined pattern thereof.

10. A heater for a vehicle mirror assembly including a reflective element having inner and outer surfaces, and a signal indicator positioned to face and direct light toward the inner surface of the reflective element, said heater comprising:

a substrate extending between the inner surface of said reflective element and the signal indicator, said substrate including an unobstructed area adapted to allow light from the signal indicator to pass therethrough;

an electrical pattern deposited on a surface of said substrate, the electrical pattern including a first zone extending across a majority of the surface of the substrate and a second zone arranged in substantially surrounding relation relative to the unobstructed area of the substrate; and a conductive layer deposited in operable combination with the first and second zones of the electrical pattern thereby providing heating capability across substantially the entire inner surface of the reflective element except for a portion of the inner surface of the reflective element where light from the signal indicator passes.

11. The heater according to claim 10, wherein said conductive layer comprises a positive temperature coefficient material which is substantially impermeable to light except for a patterned opening arranged in registry with the unobstructed area of the substrate to allow light to pass therethrough.

12. A heater for a vehicle mirror assembly including a reflective element having inner and outer surfaces, and a signal indicator positioned to face and direct light toward the inner surface of the reflective element, said heater comprising:

a substrate extending between the inner surface of said reflective element and the signal indicator, said substrate including an unobstructed area adapted to allow light from the signal indicator to pass therethrough;

an electrical pattern deposited on a surface of said substrate, the electrical pattern including a first zone extending across a majority of the surface of the substrate and a second zone arranged in substantially surrounding relation relative to the unobstructed area of the substrate; and a conductive layer deposited in operable combination with the first and second zones of the electrical pattern thereby providing heating capability across substantially the entire inner surface of the reflective element, with said conductive layer comprising a positive temperature coefficient material which is substantially impermeable to light except for a patterned opening arranged in registry with the unobstructed area of the substrate to allow light to pass therethrough; and a light diffusing treatment positioned over the unobstructed area of the heating element to diffuse light passing through the heating element.

13. The heater according to claim 12, wherein said patterned opening of the conductive layer is defined by a series of light permeable openings arranged in a predetermined pattern relative to each other.

14. The heater according to claim 12, wherein the light diffusing treatment is a light diffusing coating directly applied to the heating element.

15. The heater according to claim 14, wherein the light diffusing coating has a color added thereto such that a colored pattern of light will be visually emitted from the mirror assembly when said signal indicator is enabled.

16. A method of assembling a heater for a vehicle mirror assembly, said method comprising the acts of:

providing a heating element having an unobstructed area adapted to allow light to pass therethrough; and treating the unobstructed area of the heating element to diffuse the light passing through the substrate.

17. The method of assembling a heater according to claim 16, wherein the step of treating the unobstructed area of the heating element includes the act of applying a light diffusing coating onto the substrate over the unobstructed area.

18. The method of assembling a heater according to claim 17, wherein the act of applying a light diffusing coating comprises the further act of act of coloring the light diffusing coating such that colored and diffused light passes through the substrate.

19. The method of assembling a heater according to claim 17, wherein the act of applying a light diffusing coating comprises the further act of screen printing a predetermined pattern of said coating onto said substrate.

20. The method of assembling a heater according to claim 17, wherein the act of applying a light diffusing coating comprises the further act of varying the translucency of the light diffusing coating across the predetermined pattern thereof.

* * * * *

UNITED STATES PATENT AND TRADEMARK OFFICE
Certificate

Patent No. 6,426,485 B1 Patented: July 30, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Edward F. Bulgajewski, Genoa, IL; Timothy A. Norris, Crystal Lake, IL; Randall J. Beute, Grand Rapids, MI; Timothy A. Bonardi, Buchanan, MI; Randall S. Braun, Grand Rapids, MI; and Mark A. Snyder, Zeeland, MI.

Signed and Sealed this Seventeenth Day of February 2004.

EHUD GARTENBERG
*Supervisory Patent Examiner*
Art Unit 3742